US005240423A

United States Patent [19]

Morrison

[11] Patent Number: 5,240,423

[45] Date of Patent: Aug. 31, 1993

[54] STRUCTURAL STEEL GROUNDING CONNECTOR

[75] Inventor: Carleton L. Morrison, Derry, N.H.

[73] Assignee: Burndy Corporation, Norwalk, Conn.

[21] Appl. No.: 901,102

[22] Filed: Jun. 19, 1992

[51] Int. Cl.[5] ..... H01R 4/66

[52] U.S. Cl. ..... 439/92; 29/861; 439/94

[58] Field of Search ..... 439/92, 94, 803, 100; 174/556, 6; 29/861

[56] References Cited

U.S. PATENT DOCUMENTS

| | | | |
|---|---|---|---|
| 1,332,442 | 3/1920 | Kane . | |
| 1,377,439 | 5/1921 | Rice . | |
| 2,623,089 | 12/1952 | Greene et al. . | |
| 2,989,337 | 6/1961 | Pispisa . | |
| 3,232,393 | 2/1966 | Attwood . | |
| 3,528,050 | 11/1970 | Hindenburg | 439/92 |
| 3,627,900 | 12/1971 | Robinson . | |
| 3,686,609 | 8/1972 | Hansen | 439/92 |
| 4,256,359 | 3/1981 | Storck . | |
| 4,270,835 | 6/1981 | Kordt et al. . | |
| 4,384,753 | 5/1983 | Mixon | 439/92 |
| 4,718,266 | 1/1988 | Jarman et al. . | |
| 4,784,621 | 11/1988 | Auclair . | |
| 4,884,976 | 12/1989 | Franks, Jr. . | |
| 4,925,395 | 5/1990 | Franks, Jr. . | |

FOREIGN PATENT DOCUMENTS

| | | | |
|---|---|---|---|
| 8001475 | 9/1980 | Netherlands | 439/94 |

*Primary Examiner*—Eugene F. Desmond

*Attorney, Agent, or Firm*—Mitchell B. Wasson; Martin P. Hoffman; Burtsell J. Kearns

[57] ABSTRACT

A grounding connector capable of being clamped by compression forces to a tapered metallic flange of an I-beam. The grounding connector is rectangular when viewed in side elevation and has an upwardly opening, tapered slot that accepts the metal flange. Threaded holes extend upwardly from the bottom of the connector to allow contact screws to be advanced therethrough to establish contact therewith. The need for brazing or welding a connector to the flange is eliminated.

2 Claims, 1 Drawing Sheet

STRUCTURAL STEEL GROUNDING CONNECTOR

FIELD OF THE INVENTION

The present invention is directed to a grounding connector which is used to ground electricity to a structural beam such as an I-beam.

BACKGROUND OF THE INVENTION

It is well known in the prior art to ground various electrical devices installed in a building to the various building columns, grids or beams which are used structurally to form and support the building. One such grounding system is described in U.S. Pat. No. 2,623,089 to Greene et al in which a clip or bracket is welded directly to a girder upright or other metal element of the framework of the building to form an integral and permanent part of the building framework utilized as a grounding system.

A second manner of connecting a ground wire to a building structure, such as an I-beam, is described in U.S. Pat. No. 4,784,621 issued to Auclair. This patent illustrates a wire connector which functions as a ground clamp for clamping a ground wire to an I-beam or like member. The connector comprises a clamp having a pair of cooperative jaws which clamp directly onto the I-beam structure. It is noted that this clamp must remain in place to positively connect the grounding system. A similar type of structure is shown in U.S. Pat. No. 3,232,393 issued to Attwood, which shows a beam clamp designed to be attached to the flanges of steel I-beams and to other beams and structural elements of a metal framing construction. Although this clamp is not used in a grounding system, it is important to note that this clamp would remain semi-permanently in place.

Yet another means of connecting a grounding or short circuiting system to a structural element is illustrated in U.S. Pat. No. 1,377,439 issued to Rice. This patent discloses an appliance for short circuiting a pair of rails comprising V-shaped conductors having a pair of jaws and a pair of arms. One of the arms is adapted to bear against the underside of a rail, while the second arm is adapted to bear over the upper surface of the same rail. This arm is provided with a screw-threaded hole and a set screw or screw-threaded stud.

However, none of the prior art references describes a device in which a grounding connector is connected to a structural member, such as an I-beam, without the use of a permanently installed clamp.

SUMMARY OF THE INVENTION

The deficiencies of the prior art are overcome by the present invention which is directed to a grounding connector capable of being clamped by compression forces to the flange of a flanged metallic section or I-beam structural member. The grounding connector is rectangular when viewed in side elevation and has an upwardly opening tapered slot which accepts the metal flange. Threaded holes extend upwardly from the bottom of the connector to allow contact screws to be advanced therethrough to establish contact therewith. The need for brazing or welding a connector to the flange is thereby eliminated.

BRIEF DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts therethrough, wherein.

DETAILED DESCRIPTION OF THE PRESENT INVENTION

Figure 1:
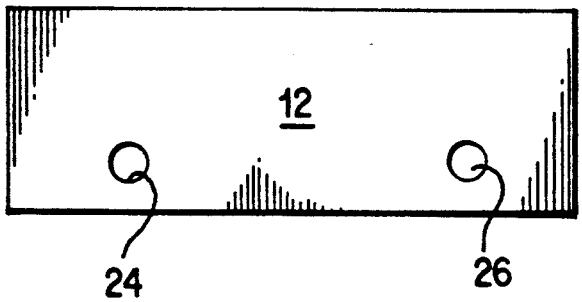
FIG. 1 is a side view of the grounding connector of the present invention.
Figure 2:
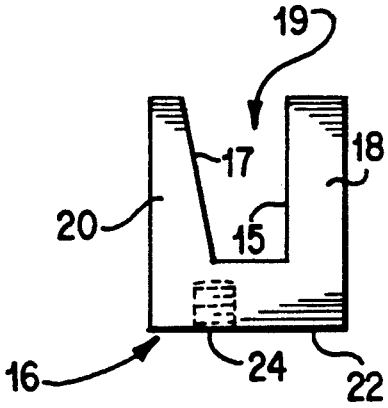
FIG. 2 is an end view of the grounding connector of the present invention.
Figure 3:
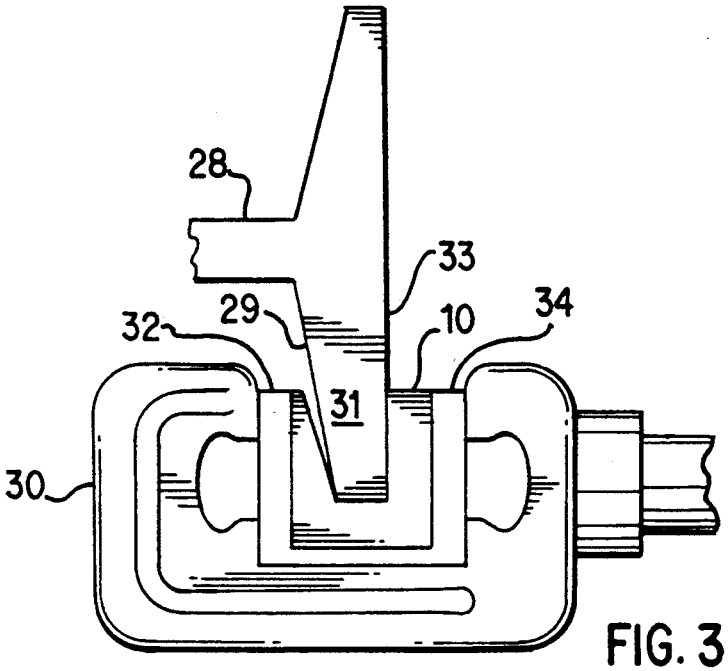
FIG. 3 is a view of the present invention being installed.
Figure 4:
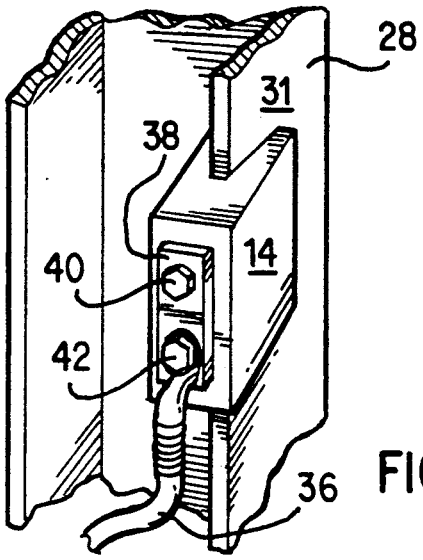
FIG. 4 is a perspective view of the present invention after installation.

The compressible grounding connector 10 of the present invention is shown particularly in FIGS. 2 and 4. This grounding connector is provided with a side surface 12 containing two threaded holes 24,26. Obviously, the number of threaded holes which can be utilized is not crucial to the present invention, and a single hole or three or more holes can be used. The connector is provided with a rectangular top surface 14 as well as a bottom surface (note shown). The connector is also provided with two opposed end surfaces 16. Each end surface is provided with a base section 22 and two leg sections 18 and 20 formed to provide a slot 19 between the leg sections 18,20. Side sections 15 and 17 of the connector cooperate to provide a tapered slot 19 to conform to the geometry of a typical I-beam 28 provided with a flange 31 having a straight side surface 33 as well as an angled surface 29.

The grounding connector 10 is designed to be attached to a portion of the flange 31 of the I-beam 28 using a standard compression clamp 30. The connector 10 is inserted between relatively smooth die bases 32,34 of the clamp 30. The clamp is then moved to the I-beam 28 and a portion of the flange 31 is inserted into the tapered slot 19 of the grounding connector 10 after this connector has been inserted into the clamp. The clamp then compresses the grounding connector around the flange 31 to permanently install the grounding connector.

FIG. 4 illustrates the grounding connector 10 after it has been permanently attached to the I-beam 28. A conductor or cable 36 is connected to the grounding connector 10 utilizing a connector bar 38 and two screws 40,42.

The grounding connector can be constructed from copper, brass or other metallic components having a high conductivity as well as the capability of being compressed.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A grounding connector to be compressed around a portion of a flange of a structural I-beam having a tapered portion for connecting a connector thereto, said tapered portion of the I-beam provided with a vertical surface, an end section and a surface angled with respect to the vertical surface at a first angle, said connector comprising:

opposed top and bottom surfaces;

a side surface joining said top and bottom surfaces;

end surfaces provided on either side of said bottom surface, said end surfaces provided with a body portion adjoining said side surface, and first and second leg portions extending from said body portion, one of said leg portions having a surface angled toward said second of said leg portions at a second angle greater than said first angle forming a tapered slot adapted to fit the tapered portion of the I-beam, wherein only the vertical surface and the end surface of the I-beam are initially brought into contact with said second leg surface and said bottom portion to position the I-beam within said connector prior to said connector being compressed around said flange of the I-beam; and a means for connecting a conductor to said connector.

2. A method of compressing a grounding connector around the portion of a flange of a structural I-beam having a tapered portion provided with a vertical surface and a surface angled with respect to the vertical surface at a first angle, before connecting a connector thereto comprising the steps of:

providing a grounding connector having an opposed top and bottom surfaces, a side surface joining said top and bottom surfaces and end surfaces provided on either side of said bottom surface, said end surfaces provided with a body portion adjoining said side surface, and first and second leg portions extending from said body portion, one of said leg portions having a surface angle toward said second of said leg portions at a second angle greater than said first angle, thereby forming a tapered slot adapted to fit the tapered portion of the I-beam;

inserting said grounding connector around a portion of the flange of said I-beam such that only the vertical surface and the end surface of said I-beam are brought into contact with said second leg surface and said bottom portion of said grounding connector to position said I-beam within said grounding connector;

providing a clamp around said grounding connector;

compressing said clamp, thereby forcing said first leg portion of said grounding connector toward, and contacting said surface angled with respect to said vertical surface of said I-beam; and connecting a conductor to said grounding connector.

* * * * *